US006678497B1

(12) United States Patent
Murata

(10) Patent No.: US 6,678,497 B1
(45) Date of Patent: Jan. 13, 2004

(54) FIXING DEVICE

(75) Inventor: Hiroshi Murata, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/237,630

(22) Filed: Sep. 10, 2002

(51) Int. Cl.[7] ..... G03G 15/20
(52) U.S. Cl. ..... 399/323
(58) Field of Search ..... 399/323, 328, 399/330, 331, 333; 219/216

(56) References Cited

U.S. PATENT DOCUMENTS 6,564,031 B2 * 5/2003 Murata ..... 399/323

FOREIGN PATENT DOCUMENTS

JP 7-181826 7/1995

JP 2000-56601 2/2000

OTHER PUBLICATIONS

U.S. patent application Ser. No. 09/955,190, Murata, filed Sep. 19, 2001.

* cited by examiner

*Primary Examiner*—Quana M. Grainger
(74) *Attorney, Agent, or Firm*—Foley & Lardner

(57) ABSTRACT

The fixing device of the present invention comprises a fixing member to contact a developer image forming surface of a recording medium, a pressure member to press contact a recording medium and convey a recording medium by clamping it together with the fixing member, and a non-contact separation member to separate a recording medium from the fixing member after passing the nip area formed between the fixing member and the pressure member, characterized in that $r/L \leqq 1$ where r is a distance from an exit of the nip area to the separation edge of the separation member and L is the minimum value of the edge margin of a recording medium

14 Claims, 8 Drawing Sheets

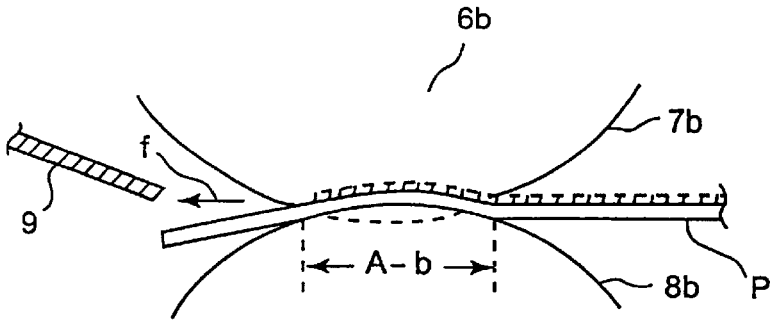
FIG.6
TABLE 1
(VALUE OF (FIXING ROLLER SURFACE HARDNESS)/
(PRESSURE ROLLER SURFACE HARDNESS) (IN TABLE)
| | FIXING ROLLER HARDNESS | | | * 2 |
|---|---|---|---|---|
| * 1 | 60 | 70 | 80 | 100 |
| 50 | 1.200 | 1.400 | 1.600 | 2.000 |
| 60 | 1.000 | 1.167 | 1.333 | 1.667 |
| 70 | 0.857 | 1.000 | 1.143 | 1.429 |
| 85 | 0.706 | 0.824 | 0.941 | 1.176 |
* 1 PRESSURE ROLLER HARDNESS
* 2 HOWEVER, THE HARD ROLLER IS APPROXIMATED TO HARNESS 100.
FIG.7
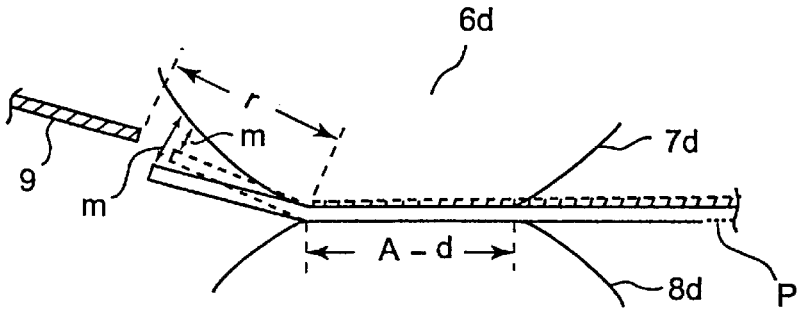
FIG.9

TABLE 2
(MIN. VALUE OF EDGE MARGING SIZE) /
(RADIUS OF FIXING ROLLER)

| | IMAGE MARGIN | | | |
|---|---|---|---|---|
| ROLLER RADIUS | 2 | 3 | 4 | 5 |
| 12.5 | 0.160 | 0.240 | 0.320 | 0.400 |
| 15 | 0.133 | 0.200 | 0.267 | 0.333 |
| 20 | 0.100 | 0.150 | 0.200 | 0.250 |
| 25 | 0.080 | 0.120 | 0.160 | 0.200 |
| 30 | 0.067 | 0.100 | 0.133 | 0.167 |

TABLE 3
(MIN. VALUE OF EDGE MARGING SIZE) /
(SPEED OF FIXING ROLLER)

| | IMAGE MARGIN | | | |
|---|---|---|---|---|
| FIXING SPEED | 2 | 3 | 4 | 5 |
| 90 | 0.022 | 0.033 | 0.044 | 0.056 |
| 130 | 0.015 | 0.023 | 0.031 | 0.038 |
| 200 | 0.010 | 0.015 | 0.020 | 0.025 |
| 300 | 0.007 | 0.010 | 0.013 | 0.017 |
| 400 | 0.005 | 0.008 | 0.010 | 0.013 |

FIXING DEVICE

BACKGROUND OF THE INVENTION

1. Field of the Invention

The present invention relates to a fixing device that is used in such image forming apparatus as copying machines, printers, facsimiles, etc. for fixing developer images that are formed on recording media.

2. Description of the Related Art

A conventional fixing device that is used in electrophotographic copying machines, printers, etc. has a separation member for separating sheet paper from a fixing roller after passing a fixing device. When this separation member is provided in contact with a fixing roller, streak traces and scratches rubbed by the separation member are produced on the surface of the fixing roller. These traces and scratches appeared on fixed images resulting in deterioration of image quality.

For example, in Japanese Patent Disclosure (Kokai) No. 7-181826, a device to separate a recording paper from a fixing roller by a non-contact separation guide using a curvature separation system is disclosed.

However, the above-mentioned non-contact separation guide may produce a separation error if a gap between it and a fixing roller is too large and to surely separate a recording paper, it is necessary to bring the separation guide to a fixing roller as close as possible. And to maintain a gap between the fixing roller and the separation guide that are closely mounted highly precise and to remove various factors affecting the gap, it is necessary to improve manufacturing and mounting accuracy of the fixing roller and to remove dimensional and mounting accuracy of the separation guide and furthermore, prevent oscillation of the fixing device when an image forming apparatus is driven so that a diameter of the fixing roller does not vary.

Accordingly, in a heating and pressure fixing device, a fixing device that is capable of surely separating sheet paper from a fixing roller, expanding a margin of manufacturing and mounting accuracy of a fixing roller and a non-contact separation member, suppressing increase in manufacturing cost and obtaining fixed images of high quality without causing trace of scratches of a fixing roller is desired.

SUMMARY OF THE INVENTION

An object of the present invention is to obtain a fixed image of high quality in a heating and pressing type fixing device by surely separating a sheet paper by a non-contact separating member without increasing a manufacturing cost.

According to an embodiment showing one example of the present invention, a fixing device comprises: a fixing member that is brought in contact with a developer image forming surface of a recording medium; a pressure member that press contacts the fixing member and conveys the recording medium by clamping it jointly with the fixing member; and a non-contact separating member that separates a recording medium after passing through a nip area formed between the fixing member and the pressing member, characterized in that $r/L \leqq 1$ where r is a distance from an exit of the nip area to the separation edge of the separation member and L is the minimum value of the edge margin of a recording medium.

BRIEF DESCRIPTION OF THE DRAWINGS

FIG. 6 is a schematic explanatory diagram showing the fixing device described in (Principle 2) and (Principle 3) of the present invention;

FIG. 7 is (Table 1) showing surface hardness ratios of the pressure roller and the fixing roller in (Test 3) of the present invention;

FIG. 9 is a schematic explanatory diagram showing a fixing device having large curvature of the fixing roller in (Principle 4) of the present invention;

DETAILED DESCRIPTION OF THE INVENTION

Principle 1

Figure 1:
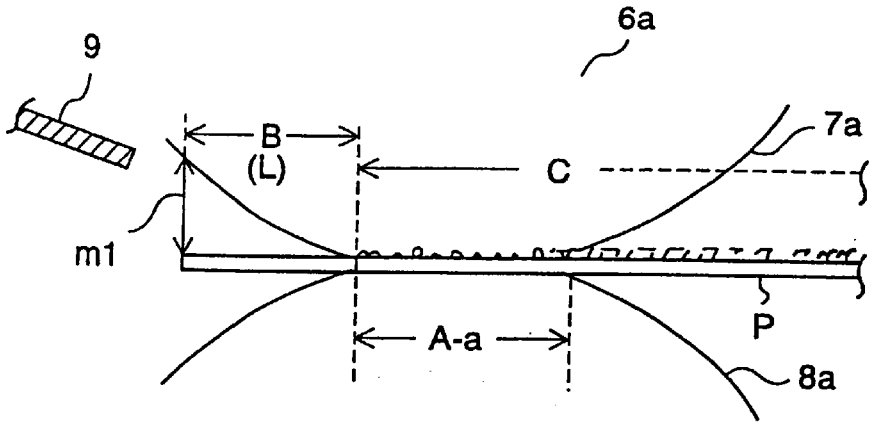
FIG. 1 is a schematic explanatory diagram showing the state where only the blank space of the edge of sheet paper Passed the exit of the nip area of the fixing device described in (Principle 1) and (Principle 5) of the present invention.

First, in the heating and pressing type fixing device, the conveying state of a sheet paper P that is a recording medium after passing a nip area A-a formed between a fixing roller 7*a* and a pressure roller 8*a* was observed as (Principle 1), using a fixing device 6*a* comprising the fixing roller 7*a* that is a fixing member, the pressure roller 8*a* that is a pressure member and a separation plate 9 that is a separation member shown in FIG. 1. Here, the fixing roller 7*a* and the pressure roller 8*a* having the same surface hardness and Asker C hardness 60° were used. As a result, the following findings were obtained.

(1) While only the edge margin of a sheet paper P is passing the exit of the nip area A-a, the sheet paper P is conveyed straight along the direction of the nip area A-a as shown in FIG. 1. As a result, a distance ml from the edge of the sheet P to the surface of the fixing roller 7*a* becomes far.

Figure 2:
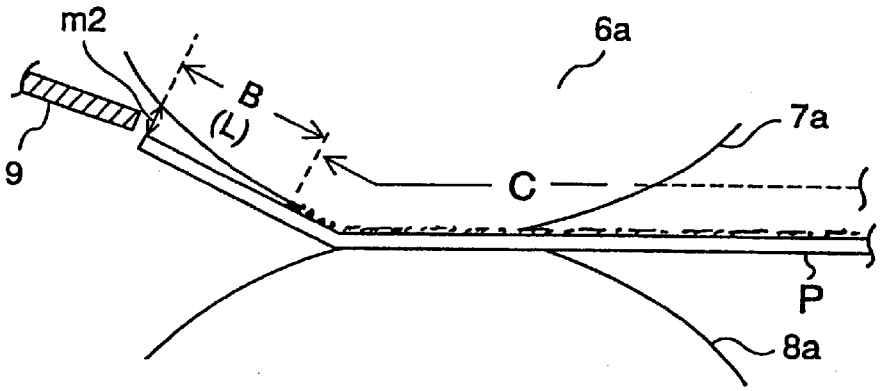
FIG. 2 is a schematic explanatory diagram showing the state where the image forming area of sheet paper Passed the exit of the nip area of the fixing device described in (Principle 1) of the present invention.

(2) When the image forming area C succeeding the edge margin of a sheet paper P passes the exit of the nip area A-a, the image forming area C of the sheet paper P often adheres to the fixing roller 7*a*, and the sheet paper P is conveyed by changing its direction toward the fixing roller 7*a* as shown in FIG. 2. As a result, a distance m2 from the edge of the sheet paper P to the fixing roller 7*a* becomes closer.

As a result, it was revealed that a distance m from the edge of sheet paper P to the surface of the fixing roller 7*a* can be made wider when the sheet paper P is separated from the fixing roller 7*a* by the separation plate 9 that is a separation member while only the edge margin B of the sheet paper P is passing through the exit of the nip area A-a.

Figure 3:
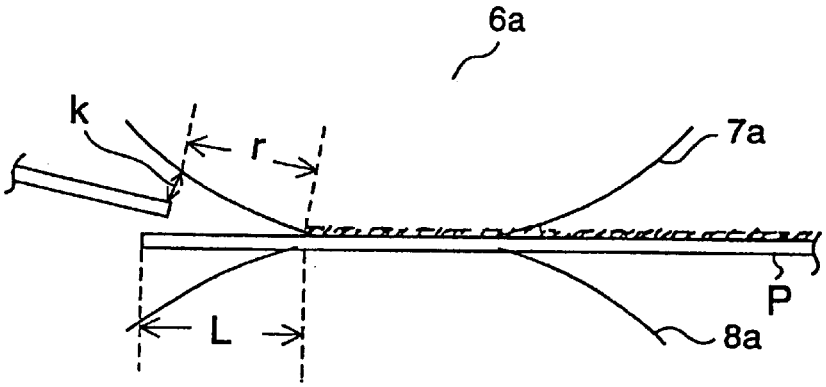
FIG. 3 is a schematic explanatory diagram showing the separation plate edge position and a gap margin of the fixing device described in (Principle 1) of the present invention.

That is, it is considered that when the edge of the separation plate 9 is brought close to the exit of the nip area A-a moderately and the edge margin B only of the sheet paper P comes out of the exit of the nip area A-a, the sheet paper P can be surely separated by the separation plate 9 by scooping the edge margin B and furthermore, the margin of gap k from the edge of the separation plate 9 to the fixing roller 7*a* can be increased as shown in FIG. 3.

Test 1

Next, using the same fixing device 6*a* as that described in (Principle 1), the sheet paper separation performance test was conducted with an A4 size solid color image of about 1.2 mg/cm$^2$ adhered toner amount fixed and the conditions of a distance r from the exit of the nip area A-a to the edge of the separation plate 9 and a minimum value L of the edge margin B of the sheet paper P changed. The distance r is a distance from the exit of the nip area A-a to and the edge of the separation plate 9 connecting with a straight line. The size of the edge margin B of the sheet paper P varies depending on paper supply timing, image data wiring timing, etc. of an image forming apparatus. In this test, the minimum value L of sizes of the edge margin B that can be provided by an image forming apparatus was used. The evaluation was made with the conditions of the minimum value of the edge margin B of sheet paper P 1 mm or more and a distance from the exit of the nip area A-a to the edge of the separation plate 9 at every 0.5 mm.

Figure 4:
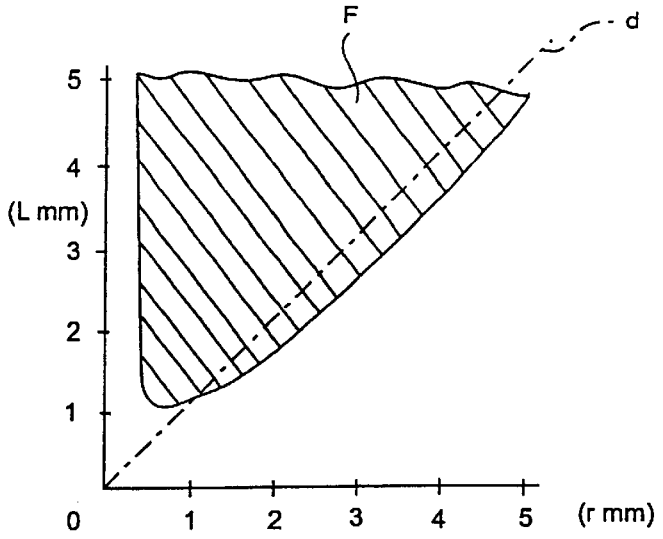
FIG. 4 is a graph showing the evaluation of the separation performance of the fixing device described in (Test 1) of the present invention.

The evaluation result is shown in FIG. 4. The hatched area F in FIG. 4 is an area where a good separation is obtained. As a result, the area of the separation performance characteristic of sheet paper P was divided by bounding with a one-dot chain line d. The minimum value L of the edge margin B of the sheet paper P is equal to a distance r from the exit of the nip area A-a to the edge of the separation plate 9. However, it was mechanically difficult to set the distance r from the exit of the nip area A-a to the edge of the separation plate 9 smaller than 0.5 mm. That is, it was revealed that a good separation performance is obtained when the separation plate is arranged so that r/L becomes equal to or larger than 1(≦1).

Test 2

Further, using the same fixing device 6*a*, a separation performance of sheet paper P was conducted with the edge margin of the sheet paper P set at 3 mm, a solid image of A4 size having adhered toner amount of about 1.2 mg/cm$^2$ fixed, and the conditions of the gap k from the edge of the separation plate 9 to the fixing roller 7*a* and the distance r from the exit of the nip area A-a to the edge of the separation plate 9 changed.

Figure 5:
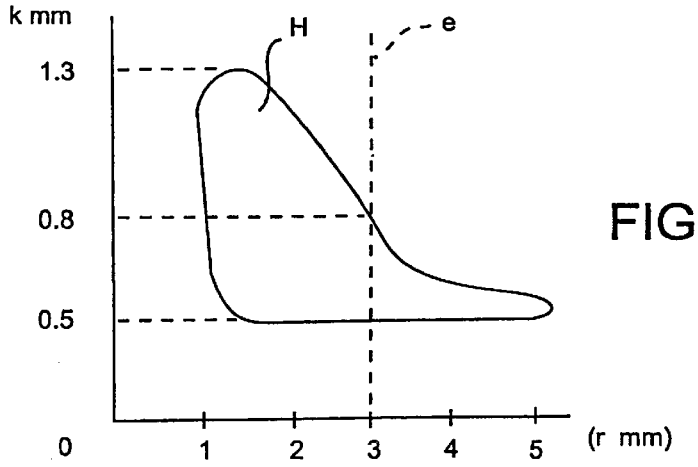
FIG. 5 is a graph showing the evaluation of the separation performance of the fixing device described in (Test 2) of the present invention.

The evaluation result is shown in FIG. 5. The area H enclosed with the solid line in FIG. 5 is an area wherein a good separation is obtained. In the portion of the area H, wherein the distance r from the exit of the nip area A-a to the edge of the separation plate 9 is short, the margin of the gap k from the edge of the separation plate 9 to the fixing roller 7*a* becomes wide. In the portion of the area H, wherein the distance r from the exit of the nip area A-a to the edge of the separation plate 9 is large, the margin of the gap k to obtain a good separation becomes narrow. For example, at the position shown by a dotted line e where r/L=1, the gap k from the edge of the separation plate 9 to the fixing roller 7*a* becomes a margin 0.5–1.3 mm.

From this test result, it was also revealed that a good separation performance is surely obtained when the separation plate 9 is arranged so that r/L becomes equal to or larger than 1 (≦1).

Principle 2

Next, the conveying state of sheet paper P after passing the nip area A-b between the fixing roller 7*b* and the pressure roller 8*b* was observed using a fixing device 6*b* comprising the fixing roller 7*b*, pressure roller 8*b* and the separation plate 9 that is the separation member instead of the fixing device 6*a* used in (Principle 1). Here, for the relation of the fixing roller 7*b* with the pressure roller 8*b*, the relation of (Surface Hardness of Fixing Roller 7*b*)<(Surface Hardness of Pressure Roller 8*b*) was used. As a result, because the surface of the fixing roller 7*b* is more soft than the surface of the pressure roller 8*b*, the nip area A-b is formed along the surface of the fixing roller 7*b* that is curved in the concave shape.

Accordingly, when the edge margin B of the sheet paper P comes out of the exit of the nip area A-b, the edge of the sheet paper P comes out in the direction toward the pressure roller 8*b*, that is, in the direction lower than an arrow f that shows the conveying direction of the sheet paper P. Therefore, it is considered that a good separation is obtained even when the edge of the separation plate 9 is arranged somewhat far from the exit of the nip area A-b when compared with (Principle 1).

Principle 3

Then, by changing the fixing device 6*a* used in (Principle 1), the relation of the fixing roller 7*b* with the pressure roller 8*b* shown in FIG. 6 was set at (Surface Hardness of Fixing Roller 7*b*)≧(Surface Hardness of Pressure Roller 8*b*). As a result, because the surface of the fixing roller 7*b* is more soft than the surface of the pressure roller 8*b*, the nip area A-b is formed along the surface of the pressure roller 8*b* that is curved in the concave shape.

Accordingly, when the edge margin B of the sheet paper P comes out of the exit of the nip area A-b, the edge of the sheet paper P comes out in the direction of the fixing roller 7*b* side, that is, in the direction upper than the arrow f that shows the conveying direction of the sheet paper P. Therefore, it becomes necessary to bring the edge of the separation plate 9 to the same level in (Principle 1) or closer to the exit of the nip area A-b.

Test 3

Then, using the fixing device 6*b* used in (Principle 2) and (Principle 3), the sheet paper P separation performance test was conducted with the surface hardness of the fixing roller 7*b* and the pressure roller 8*b* changed, the (r/L) condition changed and the A4 size solid image having toner adhered amount of about 1.2 mg/cm° fixed.

The tests were conducted using the fixing roller 7*b* and the pressure roller 8*b* both of which were in the outer diameter 40 mm, the surface hardness of the fixing roller 7*b* and the pressure roller 8*b* expressed in Asker C°, the surface hardness of the fixing roller 7*b* changed to 60°, 70°, 80°, above 100°(hard roller), the surface hardness of the pressure roller 8*b* changed to 50°, 60°, 70°, 85° and in combination of these conditions. Hardness ratios (Surface Hardness of Fixing Roller/Surface Hardness of Pressure Roller) of combined fixing roller 7*b* and pressure roller 8*b* are shown in (Table 1) in FIG. 7. Hard rollers of the surface hardness above 100° are all regarded to be hardness at 100°.

Further, when the size of the edge margin B was changed to 3, 4 and 5 mm, the same evaluation result was obtained regardless of the sizes of the edge margin B. However, when the edge margin B is large, a sheet paper can be separated even when (r/L) is less than 0.5 but if the edge margin B is below 3 mm, (r/L) 0.5 is the limit to obtain a good separation and at 0.5 or below, the separation becomes defective or high accuracy is needed for mounting the separation plate 9 and it becomes difficult to mount the separation plate 9.

Figure 8:
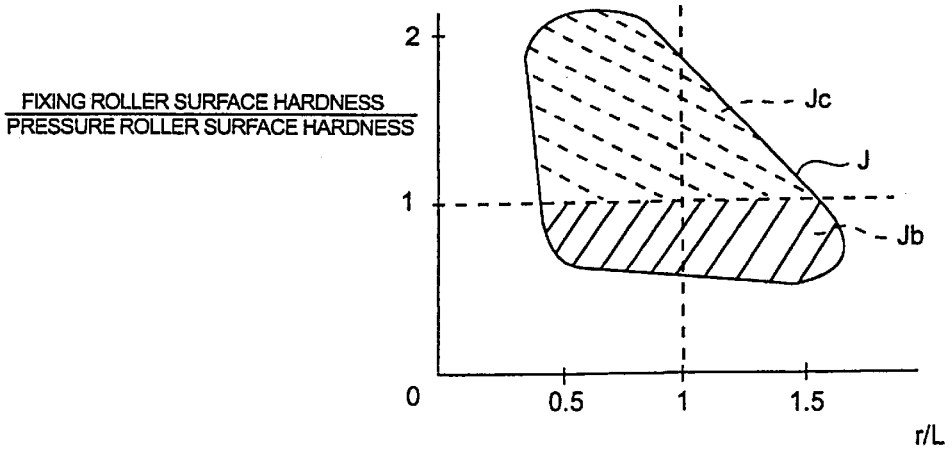
FIG. 8 is a graph showing the evaluation of the separation performance in (Test 3) of the present invention.

The evaluation result is shown in FIG. 8. The area J enclosed by the solid line in FIG. 8 is an area in which a good separation is obtained. That is, with the increase in a hardness ratio, the range of (r/L) becomes narrow. In the area J, if hardness of the fixing roller 7*b* is lower than the pressure roller 8*b*, that is, when a hardness ratio is below 1, the range of (r/L) in which a good separation is obtained is wide, and a good separation can be obtained in the hatched area Jb in FIG. 8. From this result, it was revealed that the good separation performance can be surely obtained if $0.5 \leqq r/L \leqq 1.5$ when a hardness ratio is less than 1.

On the other hand, in the area J, when hardness of the fixing roller 7*b* is larger than the pressure roller 8*b*, that is, when a hardness ratio is higher than 1, the range of (r/L) to obtain a good separation becomes narrow and a good separation is obtained in the area Jc shown by the dotted slant lines in FIG. 8. From this result, it was revealed that a good separation performance is surely obtained if $0.5 \leqq r/L \leqq 1$ when a hardness ratio is below 1.

Principle 4

Next, the conveying state of a sheet paper P after passing the nip area A-d was observed using a fixing device 6*d* shown in FIG. 9 comprising the fixing roller 7*d*, the pressure roller 8*d* and the separation plate 9 that is a separation member instead of the fixing device 6*a* used in (Principle 1), and changing the width of the nip area A-d between the fixing roller 7*d* and the pressure roller 8*d*. The curvature shown here is a curvature at the exit side of the nip area A-d.

As a result, when the curvature of the fixing roller 7*d* is large, the nip width is narrow and the edge margin B of sheet paper P is easily separated from the fixing roller 7*d*. On the other hand, when the curvature of the fixing roller 7*d* is small, the nip width is wide and the edge margin B of a sheet paper B is hardly separated from the fixing roller 7*d*. So, it was revealed that when the edge margin B of sheet paper P comes out of the exit of the nip area A-d, a distance m from the edge of sheet paper P to the surface of the fixing roller 7*d* can be taken long when the curvature of the fixing roller 7*d* is large as shown by the solid line in FIG. 9 and when the curvature of the fixing roller 7*d* is small, a distance m from the edge of sheet paper P to the surface of the fixing roller 7*d* becomes short as shown by the dotted line in FIG. 9. That is, it is considered that a good separation is obtained even when a distance r from the exit of the nip area A-d is made long when the curvature of the fixing roller 7*d* is larger than small.

Test 4

Then, the sheet paper P separation performance test was conducted using the fixing device 6*d* described in (Principle 4) with the diameters of the fixing roller 7*d* and the pressure roller 8*d* change, the condition of the minimum value 1 of the edge margin B of sheet paper P changed and an A4 size solid image having an adhered toner amount of about 1.2 $mg/cm^2$ fixed.

The separation performance was evaluated with the outer diameter of the pressure roller 8*d* kept at 40 mm, the outer diameter of the fixing roller 7*d* changed to 5 kinds of 25, 30, 40 and 60 mm, and the minimum value L of the edge margin B of the sheet paper P changed to 2, 3, 4 and 5 mm. As an index to express a curvature of the surface of the fixing roller 7*d* at the exit side of the nip area A-d, a numerical value obtained by dividing the minimum value L of the edge margin size by the radius of the fixing roller 7*d* is used. (Minimum Value L of Edge Margin Size)/(Radius of Fixing Roller) is shown in (Table 2) in FIG. 10.

Figures 10, 11:
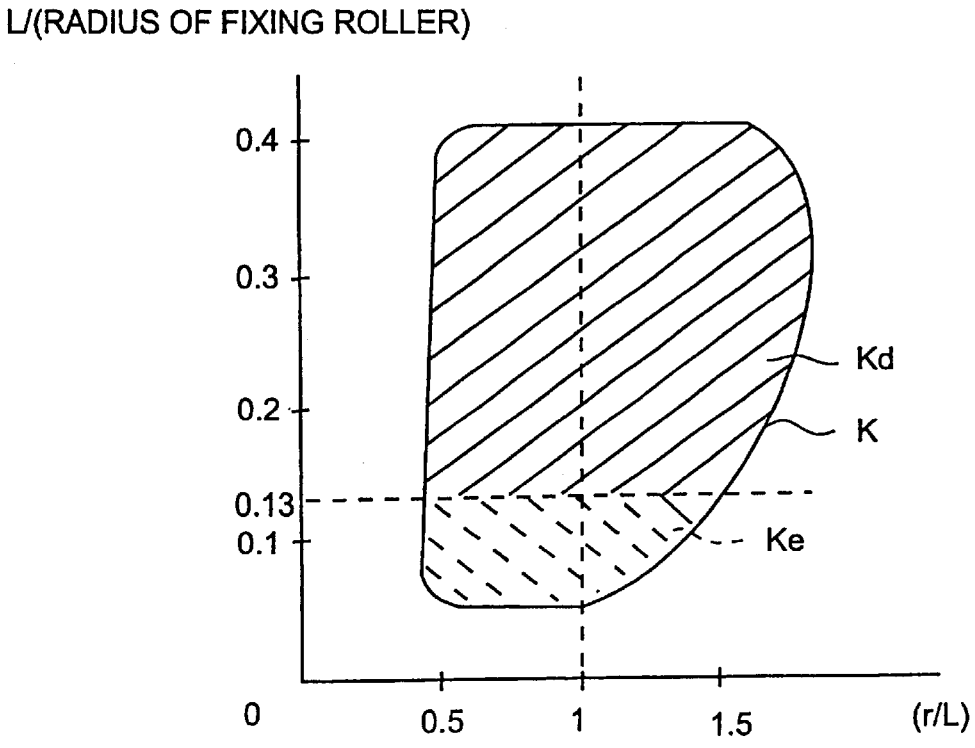
FIG. 10 is (Table 2) showing (Minimum value L of Edge Margin size)/(Radius of Fixing Roller)
FIG. 11 is a graph showing the evaluation of the separation performance in (Test 4) of the present invention.

The evaluation result is shown in FIG. 11. The area K enclosed by the solid line in FIG. 11 is an area wherein a good separation is obtained. With the increase of (Minimum Value L of Edge Margin Size)/(Radius of Fixing Roller), the range of (r/L) becomes wide. In the area K, bordering at (Minimum Value L of Edge Margin Size)/(Radius of Fixing Roller) 0.13, in a area has a large (Minimum Value L of Edge Margin size)/(Radius of Fixing roller), that is, a range of (r/L) to obtain a good separation is wide, and a good separation is obtained in the area Kd shown by the solid slant lines in FIG. 11. From this result, it was revealed that a good separation performance is surely obtained when $0.5 \leqq r/L \leqq 1.5$ if (Minimum Vale L of Edge Margin Size)/(Radius of Fixing Roller) is 0.13 or above.

On the other hand, of the area K, in an area having a curvature radius of which (Minimum Vale L of Edge Margin Size)/(Radius of fixing Roller) is smaller than 0.13, a range of (r/L) to obtain a good separation is narrow and a good separation is obtained in an area Ke shown by the dotted slant line in FIG. 11. From this result, it was revealed that when (Minimum Value L of Edge Margin Size)/(Radius of Fixing Roller) is below 0.13, a good separation performance is obtained at $0.5 \leqq r/L \leqq 1$.

Further, as the same evaluation result is obtained regardless of fluctuation of the edge margin B, FIG. 11 shows the overall result when the edge margin B varied. However, even if the edge margin B is large, a sheet paper can be separated when (r/L) is 0.5 or below. However, 0.5 is the limit (r/L) to obtain a good separation at the edge margin B 3 mm or below, and at 0.5 or below, the separation becomes defective or a high accuracy becomes necessary to mount the separation plate 9 and the mounting becomes difficult.

Further, as a size of the nip area A-d varies depending on a diameter of the fixing roller 7*d*, in this (Test 4), the conveying speed of sheet paper P was regulated according to a size of the nip area A-d in order to make substantial fixing times uniform.

Principle 5

Next, the conveying state of sheet paper P after passing the nip area A-a between the fixing roller 7*a* and the pressure roller 8*b* was observed by changing the surface speed of the fixing roller 7*a* of the fixing device 6*a* used in (Principle 1).

When the surface speed of the fixing roller is fast, the moving speed of the edge of sheet paper P after passing the exit of the nip area A-a is relatively large and therefore, it reaches the separation plate 9 before fully separated from the fixing roller 7*a* as shown by the dotted line in FIG. 1. On the other hand, when the surface speed of the fixing roller is slow, the moving speed of the edge of sheet paper P after passing the exit of the nip area A-a is relatively slow and therefore, it was found that the edge of sheet paper P is fully separated from the fixing roller 7*a* before reaching the separation plate 9 as shown by the solid line in FIG. 1. That is, it is considered that a good separation performance is obtained even when a distance r from the exit of the nip area A-a to the edge of the separation plate 9 is made longer when the surface speed of the fixing roller 7*a* is made slower rather than faster.

Test 5

Next, based on the above-mentioned (Principle 5), the sheet paper P separation performance test was conducted with the surface speed of the fixing roller 7*a* and the minimum value L condition of the edge margin B of sheet paper P changed, and A4 size solid image of adhered toner amount of about 1.2 mg/cm$^2$ fixed.

The evaluation was made with the outer diameters of both the fixing roller 7*a* and the pressure roller 8*a* set at 40 mm, the surface hardness of the fixing roller 7*a* and the pressure roller 8*a* made to AskerC60°, the surface speed of the fixing roller 7*a* changed to 90, 130. 200. 300 and 400 mm/s, and the minimum value L of the edge margin B of sheet paper P changed to 2, 3, 4 and 5 mm. As an index to express the surface speed of the fixing roller 7*a*, absolute values obtained by dividing minimum values L of edge margin sizes by a speed T of the fixing roller 7*a* that is the surface conveying speed of the fixing member are used. Absolute values of (Minimum Values L of Edge Margin Sizes)/(Fixing Roller Speed T) are shown in (Table 3) in FIG. 12.

Figures 12, 13:
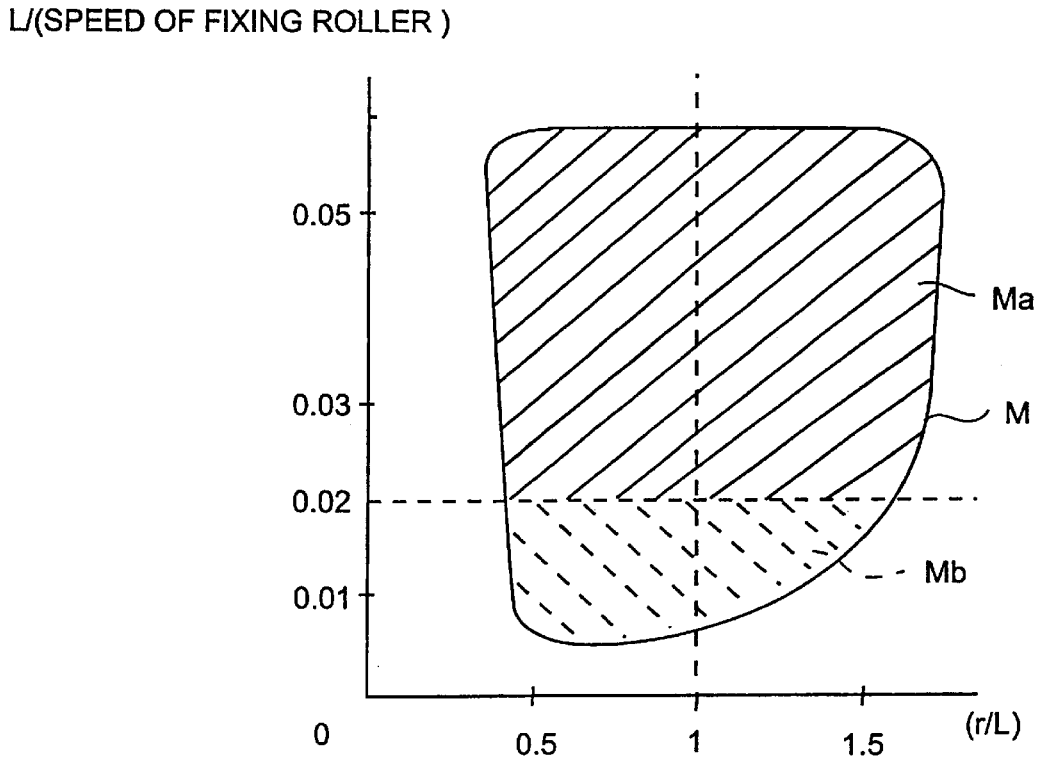
FIG. 12 is (Table 3) showing absolute values of (Minimum Value L of Edge Margin Size)/(Fixing Roller Speed T) in (Test 5) of the present invention.
FIG. 13 is a graph showing the evaluation of separation performance in (Test 5) of the present invention.

The evaluation result is shown in FIG. 13. The area M enclosed by the solid line in FIG. 13 is an area wherein a good separation is obtained. With the increase in (Minimum Value L of Edge Margin Size)/(Fixing Roller Speed T), the range of (r/L) becomes wide. In the area M, bordering at an absolute value 0.02 of (Minimum Value L of Edge Margin Size)/(Fixing Roller Speed T), a range of (r/L) to obtain a good separation becomes wide in an area of a large absolute value of (Minimum Value L of Edge Margin Size)/(Fixing Roller Speed T), that is, an area of slow surface speed of the fixing roller 7*a*, and a good separation is obtained in an area Ma shown by the solid slant lines in FIG. 13. From this result, it was revealed that when an absolute value of (Minimum Value L of Edge Margin Size)/(Fixing Roller Speed T) is 0.02 or above, a good separation performance is surely obtained at $0.5 \leqq r/L \leqq 1.5$.

On the other hand, a range of (r/L) to obtain a good separation is narrow when an absolute value of (Minimum Value L of Edge Margin Size)/(Fixing Roller Speed T) is below 0.02, and a good separation is obtained in an area Mb out of an area M shown by the dotted slant lines in FIG. 13. From this result, it was revealed that a good separation performance is surely obtained at $0.5 \leqq r/L \leqq 1$ when an absolute value of (Minimum Value L of Edge Margin Size)/(Fixing Roller speed T) is below 0.02.

Further, the same evaluation result was obtained regardless of variance of the edge margin B. However, when the edge margin B is large, sheet paper P can be separated even when (r/L) is below 0.5 but when the edge margin B is 3 mm or below, the limit for obtaining a good separation is (r/L) 0.5, and at below 0.5, the separation becomes defective or high accuracy becomes necessary to mount the separation plate 9 and the mounting becomes difficult.

Further, as a fixing time varies according to a speed of the fixing roller 7*a*, the nip width of the nip area A-a was adjusted in order to make substantial fixing times uniform.

Next, from the principles and the test results described above, preferred embodiments of the present invention will be described below referring to the attached drawings.

First Embodiment

Figure 14:
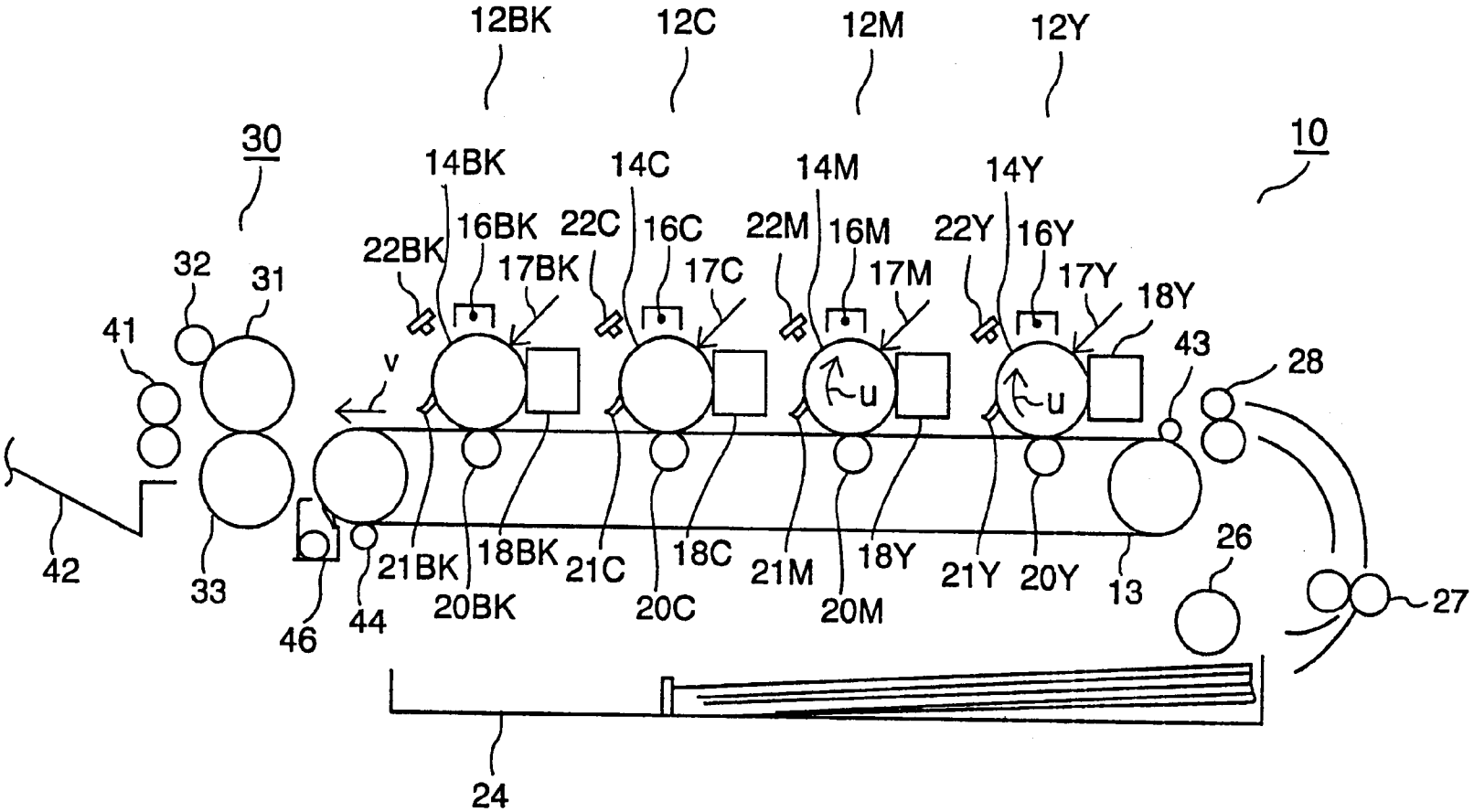
FIG. 14 is a schematic structural diagram showing the image forming unit of a color printer in a first embodiment of the present invention.

FIG. 14 is a schematic structural diagram showing an image forming unit 10 of a four tandem type full color printer that is a first embodiment of the present invention. The image forming portion 10 comprises: four sets of yellow (Y), magenta (M), cyan (C) and black (B) stations 12Y, 12M, 12C and 12BK for forming developer images using yellow (Y), magenta (M), cyan (C) and black (BK) toners, respectively arranged in parallel along a conveyor belt 13 for conveying a sheet paper P that is a recording medium.

The respective color stations 12Y, 12M, 12C and 12BK are in the same structure and will be explained referring to the yellow station 12Y arranged at the former stage, and the same component elements of other color stations 12M, 12C and 12BK will be assigned with the same reference numerals and subscripts showing respective colors and the explanation thereof will be omitted.

The yellow station 12Y is equipped with a photosensitive drum 14Y and there are a charging unit 16Y, an exposure unit (not shown) to apply an yellow (Y) optical signal 17Y, a developing unit 18Y, a transferring roller 20Y, a cleaning unit 21Y, and a charge elimination unit 22Y arranged sequentially in the rotating direction of the photosensitive drum 14Y. The transferring roller 20Y is arranged opposing to the photosensitive drum 14Y via the conveyor belt 13.

Further, below the stations 12Y, 2M, 12C and 12BK, a paper supply cassette 24 for housing sheet paper P that are recording media, a pick-up rollers 26 to taking sheet paper P out of the paper cassette 24, and paper conveying rollers 27 for conveying sheet paper P taken out of the paper cassette are arranged. Further, at the downstream side from the conveyor belt 13, a fixing device 30, a paper discharge roller pair 41, and a paper receiving tray 42 are provided. The minimum value L of the edge margin of a toner image formed on a sheet paper P by this image forming unit 10 is 3 mm.

Next, the fixing device 30 will be described in detail. A fixing roller 31, that is a fixing member in a radius 30 mm with a built-in heater 31*a* such as a heater lamp, an electromagnetic induction coil, etc., comprises a core metal 31*b* made of metal such as aluminum pipe, etc. and covered by a surface layer 31*c* of silicon rubber or sponge shaped heat resisting rubber ofAsker C hardness 60° silicon. As a result, (Minimum Value+of Edge Margin Size)/(Radius of Fixing Roller) becomes 3 mm/30 mm=0.10.

Further, an oil coating roller 32 is kept in contact with the fixing roller 31 to apply silicon oil to the fixing roller in order to prevent toner offset. The fixing roller 31 is rotated by a driving motor (not shown) at 200 mm/s that is the same surface speed of a print speed of a color printer. As a result, an absolute value of (Minimum Value L of Edge Margin Size)/(Fixing Roller Speed T) becomes 3/200=0.015.

A pressure roller 33 in a radius 30 mm that is a pressure member comprises a core metal 33*b* made of an aluminum pipe, etc. covered by a silicon rubber surface layer 33*c* and houses a heater 33*a*. The surface hardness is Asker C hardness 60° similarly to the fixing roller 31. The pressure roller 33 is loaded by a spring (not shown) between it and the fixing roller 31 and forms a nip N-1 in the shape shown in FIG. 1 and FIG. 2 as described in (Principle 1). As a result, the edge of sheet paper P after passing the nip N-1 is discharged to the extension line in the sheet paper P conveying direction shown by an arrow f in FIG. 15.

A separation plate 34 that is a separation member is made of stainless steel, etc. and arranged so that a distance r from the nip N-1 of a separation plate edge 34*a* becomes 2 mm and a distance k from the fixing roller 31 becomes 0.8 mm.

Next, the actions of the fixing device will be described below. When the printing operation is started, in the yellow (Y), magenta (M), cyan (C) and black (BK) stations 12Y, 12M, 12C and 12BK of the image forming unit 10, the charging, exposing and developing processes are applied in order on photosensitive drums 14Y, 14M. 14C and 14BK and yellow (Y), magent (M), cyan (C) and black (BK) toner images are formed.

In synchronous with the color toner image forming operations on the photosensitive drums 14Y, 14M, 14C and 14BK, a sheet paper P is supplied from the paper cassette 24 and this sheet paper P is sent on the conveyor belt 13.

While the sheet paper P sent to the conveyor belt 13 is conveyed in the arrow direction v with the running of the conveyor belt 13, yellow (Y), magenta (M), cyan (C) and black (BK) toner images are transferred on the sheet paper P at the positions of the transfer rollers 20Y, 20M, 20C and 20BK. Thus, a full-color toner image is formed and conveyed to a fixing device 30 wherein the image is heated to a prescribed temperature by the heaters 31*a* and 33*a*.

The sheet paper P is heated, pressed and fixed while it is conveyed through the nip N-1 formed between the fixing roller 31 and the pressure roller 33 of the fixing device 30 in the arrow direction v. The sheet paper P discharged from the fixing device 30 reaches the separation plate 34, and separated from the edge and discharged on the receiving tray 42.

When an A4 size solid image with adhered toner amount of about 1.2 mg/cm$^2$ was formed and the fixing test was conducted using the fixing device 30 in this embodiment, a separation error of the separation plate was not produced nor jam was generated.

According to the fixing device 30 in the above-mention structure in this first embodiment, the distance r from the separation plate edge 34*a* to the fixing roller 31 was set at a position so that it becomes 2 mm shorter than the minimum value L of the edge margin =3 mm to satisfy the value $0.5 \leqq r/L \leqq 1$ that was obtained from the (Test 2). Therefore, although the separation plate edge 34*a* can be set at a point separated by 0.8 mm from the fixing roller 31, a sheet paper P can be surely separated. Further, a gap margin between the separation plate edge 34*a* and the fixing roller 31 can be made larger than before and therefore, a high manufacturing accuracy and mounting accuracy are not demanded for he fixing roller 31 and the separation plate 34 and manufacturing costs can be reduced.

Second Embodiment

A second embodiment of the present invention differs from the first embodiment in the radius of the fixing roller and the location of the separation plate; however, other elements are the same as the first embodiment and therefore, the same elements as those of the structure described in the first embodiment will be assigned with the same reference numerals and the detailed explanation thereof will be omitted.

In this second embodiment, the radius of the fixing roller 31 is 20 mm, the distance r from the exit of the nip N-1 of the separation plate 34 is made longer than that in the first embodiment, the distance r from the nip N-1 of the separation plate edge 34*a* is 4 mm, the distance k from the fixing roller 31 is 1.0 mm, and r/L is 4/3. Further, in this embodiment, (Minimum Value L of Edge Margin Size)/(Radius of Fixing Roller) is 3 mm/20 mm=0.15.

The sheet paper P with a full-color toner image transferred in the printing operation is heated, pressed and fixed while passing through the nip N-1 formed between the fixing roller 31 and the pressure roller 33 of the fixing device 30-2, separated from the edge in order by the separation plate 34 and discharged in the receiving tray 42.

When an A4 size solid image of adhered toner amount of about 1.2 mg/cm$^2$ was formed and the fixing test was conducted using the fixing device 30 in this second embodiment, a satisfactory separation result similar to the first embodiment was obtained.

According to the fixing device 30 in this second embodiment in the structure as described above, an absolute value of (Minimum Value L of Edge Margin Size)/(Radius of Fixing Roller) is 0.15 and the separation plate edge 34*a* is arranged at the position wherein R/L becomes 4/3 so as to satisfy $0.5 \leqq r/L \leqq 1$ that was obtained from the (Test 4). Therefore, a sheet paper P can be surely separated by the separation plate 34. Further, likewise the first embodiment, the gap margin formed between the separation plate 34*a* and the fixing roller 31 can be expanded larger than before and manufacturing costs can be reduced.

Third Embodiment

This third embodiment of the present invention differs from the first embodiment in the fixing roller speed T and the location of the separation plate; however, as other elements are the same as the first embodiment, the same elements as those of the structure described in the first embodiment will be assigned with the same reference numerals and the detailed explanation thereof will be omitted.

In this third embodiment, the fixing roller speed T is 130 mm/s, the distance r of the separation plate 34 from the exit of the nip N-1 is longer than that in the first embodiment, the distance r of the separation plate edge 34*a* from the nip N-1 is 4.2 mm, the distance k from the fixing roller 31 is 1.1 mm and r/l is 1.4. Further, in this embodiment, an absolute value of (Minimum Value L of Edge Margin Size)/(Fixing Roller Speed T) is 3/130=0.023.

The sheet paper P with a full-color toner image transferred by the printing operation is heated, pressed and fixed while passing through the nip N-1 formed between n the fixing roller 31 and the pressure roller 33 of the fixing device 30, separated in order from the edge by the separation plate 34 and discharged in the receiving tray 42.

When an A4 size solid image of adhered toner amount of about 1.2 mg/cm$^2$ was formed and the fixing test was conducted using the fixing device 30 in this embodiment, a satisfactory separation result was obtained likewise the first embodiment.

According to the fixing device 30 in this third embodiment in the structure as described above, an absolute value of (Minimum Value L of Edge Margin Size)/(Fixing Roller Speed T) is 0.23 and the separation plate edge 34*a* is arranged at the position wherein r/L becomes 1.4 so as to satisfy $0.51 \leqq r/L \leqq 1.5$ that was obtained from the (Test 5). Therefore, the sheet paper P can be surely separated by the separation plate 34. Further, similarly to the first embodiment, the gap margin between the separation plate 34*a* and the fixing roller 31 can be expanded larger than before and manufacturing costs can be educed.

Fourth Embodiment

The fourth embodiment of the present invention differs from the first embodiment in the surface hardness of the fixing roller and the pressure roller of the fixing device 30 and further, the location of the separation plate; however, other elements are same as those in the first embodiment and therefore, the same elements as those in the structure explained in the first embodiment will be assigned with the same reference numerals and the detailed explanation thereof will be omitted.

Figure 16:
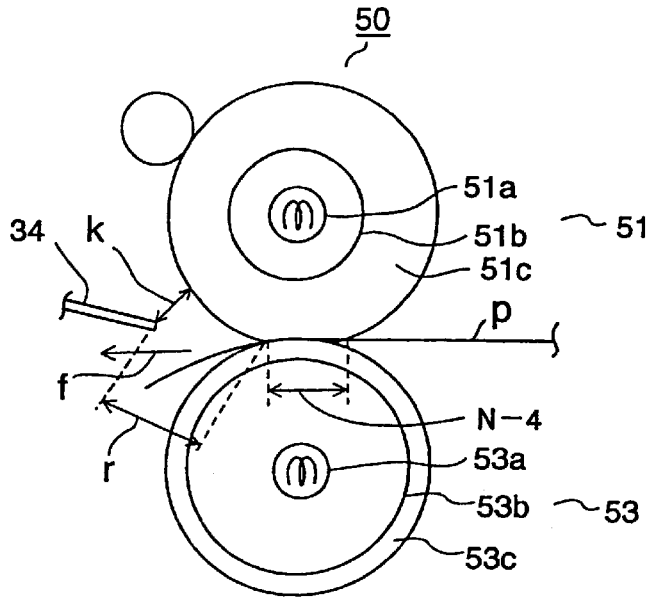
FIG. 16 is a schematic structural diagram showing the fixing device in the fourth embodiment of the present invention.

A fixing roller 51 of a fixing device 50 in the fourth embodiment shown in FIG. 16 comprises a core metal 51*b* that houses a heater 16*a* and is covered by a surface layer 51*c* of Asker C hardness 60°. A heating roller 53 comprises a core metal 53*b* that houses a heater 53*a* and is covered by a surface layer 53*c* of Asker C hardness 80°. Accordingly, a hardness ratio of the fixing roller 51 and the pressure roller 53 is 0.75. By the load of the pressure roller 53, a nip N-4 curved in the concave shape on the fixing roller 51 is formed between the pressure roller 53 and the fixing roller 51 as shown in FIG. 16. As a result, the edge of sheet paper P after passing the nip N-4 is discharged to a point lower than the extension line in the sheet paper P conveying direction shown by an arrow f in FIG. 16.

The separation plate 34 is arranged so that the distance r from the nip N-4 of the separation plate edge 34*a* becomes 4.3 mm and the distance k from the fixing roller 51 becomes 1.43. Thus, the r/L of this fixing device 50 becomes 1.43.

The sheet paper P with a full-color toner image formed by the printing operation is heated, pressed and fixed while passing through the nip N-4 formed between the fixing roller 51 and the pressure roller 53, and separated in order from the edge by the separation plate 34 and discharged in the receiving tray 42.

When an A4 size solid image with adhered toner amount of about 1.2 mg/cm$^2$ was formed and the fixing test was conducted using the fixing device 30 in this embodiment, a satisfactory separation result was obtained likewise the first embodiment.

According to the fixing device 50 in this fourth embodiment in the structure as described above, a hardness ratio is 0.75 and the separation plate edge 34*a* is arranged at the position wherein r/L becomes 1.43 so as to satisfy $0.5 \leqq r/L \leqq 1.5$ that was obtained from the above-mentioned (Test 3). Therefore, a sheet paper P can be surely separated by the separation plate 34. Further, similarly to the first embodiment, the gap margin between the separation plate edge 34*a* and the fixing roller 51 can be expanded larger than before and manufacturing costs of the fixing roller 51 and the separation plate 34 can be reduced.

Fifth Embodiment

The fifth embodiment of the present invention differs from the first embodiment in the surface hardness of the fixing roller and the pressure roller of the fixing device 30 and further, the location of the separation plate; however, other elements are same as those in the first embodiment and therefore, the same elements as those in the structure explained in the first embodiment will be assigned with the same reference numerals and the detailed explanation thereof will be omitted.

Figure 17:
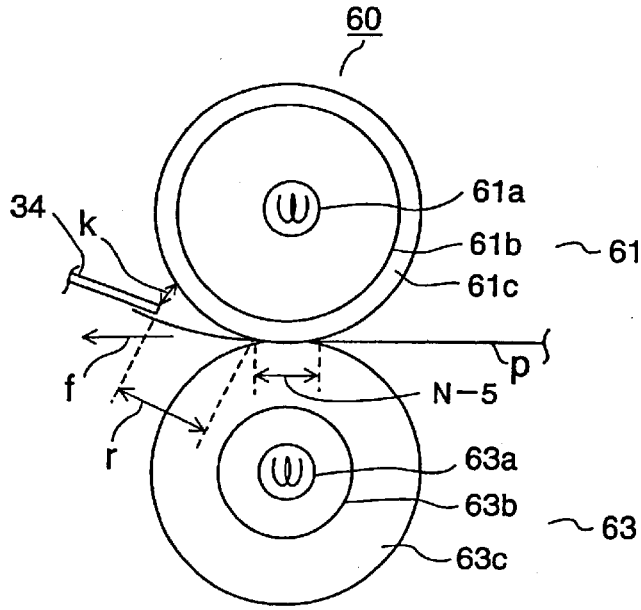
FIG. 17 is a schematic structural diagram showing the fixing device in the fifth embodiment of the present invention.

A fixing roller 61 of a fixing device 60 shown in FIG. 17 comprises a core metal 61*b* that houses a heater 16*a* and is covered by a surface layer 61*c* of Asker C hardness 80°. A heating roller 63 comprises a core metal 63*b* that houses a heater 63*a* and is covered by a surface layer 63*c*, and the surface hardness is Asker C hardness 60°. Accordingly, a hardness ratio of the fixing roller 61 and the pressure roller 63 becomes 1.33. By the load of the pressure roller 63, a nip N-5 curved in the concave shape on the fixing roller 63 is formed between the pressure roller 63 and the fixing roller 61 as described in (Principle 3). As a result, the edge of sheet paper P after passing the nip N-5 is discharged to the upper point of the extension line in the sheet paper P conveying direction shown by an arrow f in FIG. 17.

The separation plate 34 is arranged so that the distance r from the nip N-5 of the separation plate edge 34*a* becomes 2 mm and the distance k from the fixing roller 61 becomes 0.7 mm. The r/L of this fixing device 60 becomes 2/3.

The sheet paper P with a full-color toner image formed by the printing operation is heated, pressed and fixed while passing through the nip N-5 formed between the fixing roller 61 and the pressure roller 63 of the fixing device 60, and separated in order from the edge by the separation plate 34 and discharged in the receiving tray 42.

When an A4 size solid image with adhered toner amount of about 1.2 mg/cm$^2$ was formed and the fixing test was conducted using the fixing device 60 in this embodiment, a satisfactory separation result was obtained likewise the first embodiment.

According to the fixing device 60 of this fifth embodiment in the structure as described above, a hardness ratio is 1.33 and the separation plate edge 34*a* is arranged at the position wherein r/L becomes 2/3 so as to satisfy $0.5 \leqq r/L \leqq 1$ that was obtained from the (Test 3). Therefore, sheet paper P can be surely separated by the separation plate 34. Further, similarly to the first embodiment, the gap margin between the separation plate edge 34*a* and the fixing roller 61 can be expanded larger than before and the manufacturing costs of the fixing roller 61 and the separation plate 34 can be reduced.

Sixth Embodiment

The sixth embodiment of the present invention differs from the first embodiment in the curvature of the fixing roller of the fixing device 30 and other elements are same as those in the first embodiment and therefore, the same elements as of the structure described in the first embodiment will be assigned with the same reference numerals and the detailed explanation thereof will be omitted.

Figure 18:
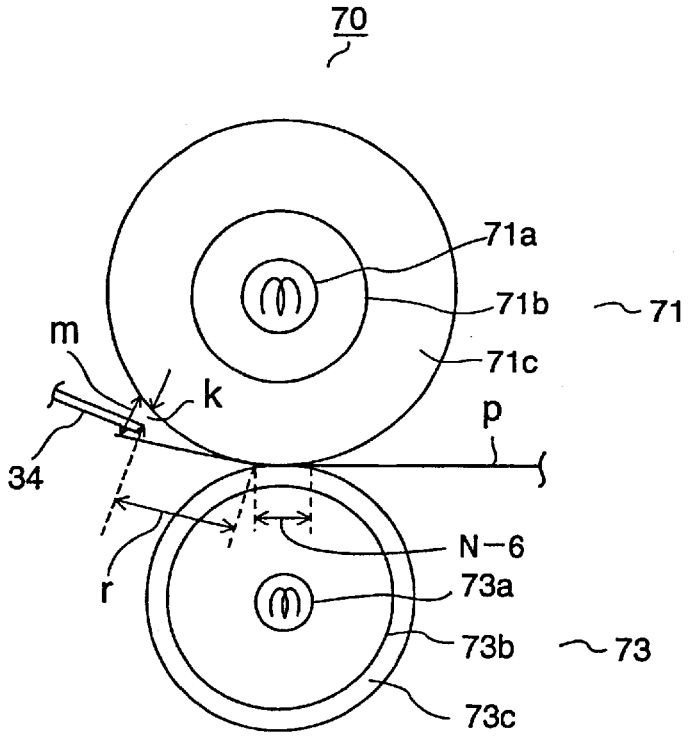
FIG. 18 is a schematic structural diagram showing the fixing device in the sixth embodiment of the present invention.

A fixing roller 71 of a fixing device 70 shown in FIG. 18 comprises a core metal 71*b* that houses a heater 71*a* and is covered by a surface layer 71*c* of Asker C hardness 60° in a radius 25 mm. Thus, an absolute value of (Minimum Value L of Edge Margin Size)/(Radius of Fixing Roller) becomes 0.12. A heating roller 73 comprises a core metal 73*b* that houses a heater 73*a* and is covered by a surface layer 73*c*. The surface hardness is Asker C hardness 60° and the radius is 20 mm. Accordingly, as described in (Principle 4), the area of a nip N-1 formed between the fixing roller 71 and the pressure roller 73 becomes wider than the nip N-1 of the first embodiment and a distance m from the edge of sheet paper P to the fixing roller 71 becomes more narrow than that in the first embodiment.

The separation plate 34 is arranged so that the distance r from the nip N-1 of the separation plate edge 34*a* becomes 2 mm and the distance k from the fixing roller 71 becomes 0.6 mm. The r/L of this fixing device 70 becomes 2/3.

The sheet paper P with a full-color toner image formed thereon at the yellow (Y) magenta (M), cyan (C) and black (BK) stations 12Y, 12M, 12C and 12BK is heated, pressed and fixed while passing through the nip N-1 formed between the fixing roller 71 and the pressure roller 73 of the fixing device 70, and separated in order from the edge by the separation plate 34 and discharged in the receiving tray 42.

When an A4 size solid image with adhered toner amount of about 1.2 mg/cm$^2$ was formed and the fixing test was conducted using the fixing device 70 in this embodiment, a satisfactory separation result was obtained likewise the first embodiment.

According to the fixing device 70 of this sixth embodiment in the structure as described above, an absolute value of(Minimum Value of Edge Margin Size)/(Radius of Fixing Roller) is 0.12 and the separation plate edge 34*a* is arranged at the position wherein r/L becomes 2/3 so as to satisfy $0.5 \leqq r/L \leqq 1$ that was obtained from the (Test 3). Therefore, a sheet paper P can be surely separated by the separation plate 34. Further, similarly to the first embodiment, the gap margin between the separation plate edge 34*a* and the fixing roller 71 can be expanded larger than before and manufacturing costs can be reduced.

Seventh Embodiment

A seventh embodiment of the present invention differs from the first embodiment in the printing speed of a color printer, the conveying speed of a sheet paper P of the fixing device 30, and the arrangement of the separation plate; however, other elements are the same as those of the first embodiment, the same structural components described in the first embodiment will be assigned with the same reference numerals and the detailed explanation thereof will be omitted.

Figure 15:
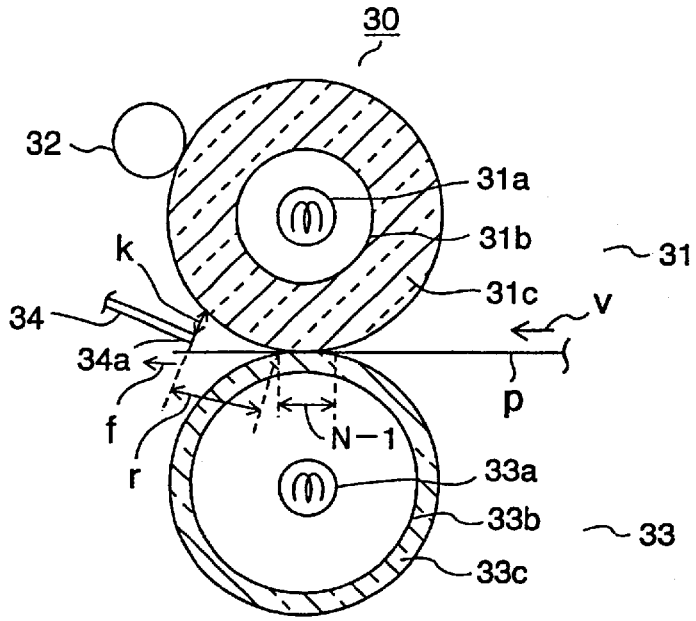
FIG. 15 is a schematic structural diagram showing the fixing device in the first, second, third and seventh embodiments of the present invention.

The fixing device 30 of this seventh embodiment uses the same fixing roller 31 and the pressure roller 33 as used in the first embodiment shown in FIG. 15. In this embodiment, the sheet paper P conveying speed by the fixing device 30 is 300 mm/s that is higher that the conveying speed in the first embodiment. Accordingly, the edge of the sheet paper P after passing the exit of the nip N-1 formed between the fixing roller 31 and the pressure roller 33 becomes closer to the fixing roller 31 than the first embodiment.

The separation plate 34 is arranged so that the distance r from the nip N-1 of the separation plate edge 34*a* becomes 2.5 mm and the distance k from the fixing roller 71 becomes 0.7 mm. The r/L of this fixing device 50 becomes 0.83.

The sheet paper P with a full-color toner image formed thereon is heated, pressed and fixed while passing through the nip N-1 formed between the fixing roller 31 and the pressure roller 33 of the fixing device 30, and separated in order from the edge by the separation plate 34 and discharged in the receiving tray 42.

When an A4 size solid image with adhered toner amount of about 1.2 mg/cm$^2$ was formed and the fixing test was conducted using the fixing device 30 in this embodiment, a satisfactory separation result was obtained likewise the first embodiment.

According to the fixing device 30 of this seventh embodiment in the structure as described above, an absolute value of(Minimum Value of Edge Margin Size)/(Fixing Roller Speed T) is 0.01 and the separation plate edge 34*a* is arranged at the position wherein r/L becomes 0.83 so as to satisfy $0.5 \leqq r/L \leqq 1$ that was obtained from the (Test 5). Therefore, a sheet paper P can be surely separated by the separation plate 34. Further, similarly to the first embodiment, the gap margin between the separation plate edge 34*a* and the fixing roller 71 can be expanded larger than before and manufacturing costs can be reduced.

Further, the present invention is not limited to the above-mentioned embodiments but can be modified variously without departing from the scope thereof. For example, the structure of an image forming apparatus in which the fixing device of the present invention loaded is not limited but may be in such a structure that plural developing devices are provided around a photosensitive drum and toner images in different colors are formed thereon in order by rotating the drum several times and an intermediate transferring medium is also usable for transferring an image. Further, the fixing member may be a fixing belt that is put over a pressure roller and a driving roller, and a separation member may have a pointed claw shape edge.

As described above in detail, according to the present invention, when a separation member is arranged at a point so as to make $r/L \leqq 1$ where r is a distance from the exit of a nip area to the edge of a separation member and L is the minimum value of the edge margin of a recording medium, a gap margin between a separation member and a fixing member when they are provided in the non-contact state can be expanded larger than before. Accordingly, high accuracy for manufacturing and mounting fixing member demanded so far in order for maintaining the gap at a high level of accuracy can be relieved, manufacturing costs also can be reduced and fixed images of high quality is obtained at a low cost.

Further, according to this invention, when the surface hardness of the fixing member is smaller than that of the pressure member or $L/S>0.13$ where S is a radius of the fixing member at the exit side of a nip area or an absolute value of L/T is less than 0.02 where T is the conveying speed of the fixing member, by arranging a separation member so as to get $0.5 \leqq r/L \leqq 1.5$, a gap margin between the separation member and the fixing member can be expanded larger than before, manufacturing costs can be reduced and a fixed image of high quality is obtained at a low cost.

What is claimed is:

1. A fixing device comprising:

a fixing member to contact a developer image forming surface of a recording medium;

a pressure member to contact the fixing member and convey a recording medium by clamping it together with the fixing member; and a non-contact separation member to separate a recording medium from the fixing member after passing the nip area formed between the fixing member and the pressure member;

characterized in that $r/L \leqq 1$ where r is a distance from an exit of the nip area to the separation edge of the separation member and L is the minimum value of the edge margin of a recording medium.

2. A fixing device according to claim 1, wherein $0.5 \leqq r/L \leqq 1$ when (Surface Hardness of Fixing Member)$\leqq$(Surface Hardness of Pressure Member).

3. A fixing device according to claim 1, wherein $0.5 \leqq r/L \leqq 1$ when $L/S \leqq 0.13$ where S is a radius of the fixing member at the exit side of the nip area.

4. A fixing device according to claim 1, wherein $0.5 \leqq r/L \leqq 1$ where T is a surface conveying speed of the fixing member and an absolute value of L/T is below 0.02.

5. A fixing device according to claim 1, wherein the fixing member is in the roller shape and the pressure member is in the roller shape.

6. A fixing device according to claim 5, wherein $0.5 \leqq r/L \leqq 1$ when (Surface Hardness of Fixing Member)≧(Surface Hardness of Pressure Member).

7. A fixing device according to claim 5, wherein $0.5 \leqq r/L \leqq 1$ when $L/S \leqq 0.13$ where S is a radius of the fixing member at the exit side of the nip area.

8. Aiding device according to claim 5, wherein $0.5 \leqq r/L \leqq 1$ when an absolute value of L/T is above 0.02, where T is a surface conveying speed of the fixing device.

9. A fixing device comprising:

a fixing member to contact a developer image forming surface of a recording medium;

a pressure member to press contact the fixing member and convey a recording medium by clamping it together with the fixing member; and a non-contact separation member to separate a recording medium from the fixing member after passing the nip area formed between the fixing member and the pressure member; and characterized in that $0.5 \leqq r/L \leqq 1.5$ when (Surface Hardness of Fixing Member)<(Surface Hardness of Pressure Member).

10. A fixing device according to claim 9, wherein the fixing member is in the roller shape and the pressure member is in the roller shape.

11. A fixing device comprising:

a fixing member to contact a developer image forming surface of a recording medium;

a pressure member to press contact the fixing member and convey a recording medium by clamping it together with the fixing member; and a non-contact separation member to separate a recording medium from the fixing member after passing the nip area formed between the fixing member and the pressure member; and characterized in that $0.5 \leqq r/L \leqq 1.5$ when $L/S > 0.13$ where S is a radius of the fixing member at the exit side of the nip area where r is a distance from the exit of the nip area to the separation edge of the separation member and L is the minimum value of the edge margin of a recording medium.

12. A fixing device according to claim 11, wherein the fixing member is in the roller shape and the pressure member is in the roller shape.

13. A fixing device comprising:

a fixing member to contact a developer image forming surface of a recording medium;

a pressure member to press contact the fixing member and convey a recording medium by clamping it together with the fixing device; and a non-contact separation member to separate a recording medium from the fixing member after passing the nip area formed between the fixing member and the pressure member, and characterized in that $0.5 \leqq r/L \leqq 1.5$ when absolute value of L/T is above 0.02 where T is the surface conveying speed of the fixing member of the fixing member when r is a distance from the exit of the nip area to the separation edge of the separation member and L is the minimum value of the edge margin of a recording medium.

14. A fixing device according to claim 13, wherein the fixing member is in the roller shape and the pressure member is in the roller shape.

* * * * *